United States Patent [19]

Uno et al.

[11] 4,415,785

[45] Nov. 15, 1983

[54] TIMER SWITCH

[75] Inventors: Kuniaki Uno; Saichi Katumata; Toshio Tanaka, all of Susono; Hiroshi Omata, Gotenba, all of Japan

[73] Assignee: Kabushiki Kaisha Higashifuji Seisakusho, Tokyo, Japan

[21] Appl. No.: 271,616

[22] Filed: Jun. 8, 1981

[30] Foreign Application Priority Data

Jun. 23, 1980 [JP] Japan ..... 55-84767

[51] Int. Cl.[3] ..... H01H 43/10

[52] U.S. Cl. ..... 200/38 B; 200/27 B; 200/39 R

[58] Field of Search ..... 200/27 R, 27 B, 27 BA, 200/30 R, 30 A, 31 R, 31 A, 38 R, 38 B, 38 BA, 38 C, 38 CA, 39 R, 39 A

[56] References Cited

U.S. PATENT DOCUMENTS

| | | | |
|---|---|---|---|
| 3,823,280 | 7/1974 | Obermann et al. | 200/38 B |
| 3,824,357 | 7/1974 | Brown et al. | 200/38 B |
| 3,941,000 | 3/1976 | Allison, Jr. | 200/38 FA X |
| 4,123,915 | 11/1978 | Stoor | 200/38 B |

*Primary Examiner*—J. R. Scott

*Attorney, Agent, or Firm*—Darby & Darby

[57] ABSTRACT

A timer switch comprises a cam member of a generally disc shape having a cam surface at its periphery. The cam surface is stepped to provide a depressed portion and a shoulder portion adjacent thereto. The cam surface has a notch formed in the shoulder portion and opening to one side of the cam member. The cam member is operatively connected to a motor for rotation. A shaft is mounted on a casing for rotation about and displacement along the axis thereof. The cam member is fixedly mounted on the shaft for rotation therewith. An electrical switching means comprises a pair of first and second contact plates of a resilient material. The first contact plate is biased into sliding engagement with the cam surface. The second contact plate is biased normally into engagement with the first contact plate for energizing the motor to rotate the cam member. Upon depression of the first contact plate into the depressed portion the second contact plate engages the shoulder portion to de-energize the motor. Upon axial displacement of the shaft, the second contact plate is moved into the depressed portion through the notch so that the second contact plate is again biased into engagement with the first contact plate to reset the timer switch.

8 Claims, 13 Drawing Figures

TIMER SWITCH

BACKGROUND OF THE INVENTION

1. Field of the Invention

This invention relates to a timer switch for use, for example, in home appliances such as ranges.

2. Prior Art

One known timer switch 100 schematically shown in FIGS. 1A to 1C comprises a cam member 101 of a generally disc-shape having a cam surface 102 at its periphery, the cam surface being stepped to provide a depressed portion 103 and a shoulder portion 104 adjacent thereto. The cam member 101 is fixedly mounted on a shaft 105 rotatably mounted on a casing (not shown). The shaft 105 is operatively connected to an electric motor M for rotation about its axis, the motor being mounted on the casing. Three electrical contact plates 106, 107, 108 of a resilient material are mounted on the casing. The first contact plate 106 is biased normally into sliding engagement with the cam surface 102 at its free end, and the second contact plate 107 is biased normally into engagement with the first contact plate 106. The motor M is driven to rotate the cam member 101 at a constant speed in a counterclockwise direction as indicated by an arrow in FIGS. 1A to 1C which show the sequence of the operation of the cam member 101. The cam member 101 continues to rotate so that the first contact plate 106 slides over the shoulder portion 104 into the depressed portion 103 whereupon the second contact plate 107 is brought into engagement with the shoulder portion 104 with the third contact plate 108 engaging the second contact plate 107. An A.C. power source 110, the three contact plates 106, 107, 108, the motor M and a load L are electrically connected to provide a circuit as shown in FIG. 2. While the first contact plate 106 engages the second contact plate 107, a circuit through the motor M is closed so that the motor M is energized to rotate the cam member 101. When the second contact plate 107 engages the third contact plate 108, a circuit through the load L is closed, and the motor M is de-energized to stop the rotation of the cam member 101. This conventional timer switch 100 has a finger grip or the like operatively connected to the cam member 101 and arranged exteriorly of the casing. The timer switch 100 is reset by angularly moving the cam member 101 about the shaft 105 from the position in FIG. 1C to the position in FIG. 1A through the finger grip. Thus, this known timer switch 100 has been found not entirely satisfactory in that the resetting can not be carried out easily.

SUMMARY OF THE INVENTION

It is therefore an object of this invention to provide a timer switch having means whereby the resetting of the timer switch can be made quite easily and quickly.

According to the present invention, there is provided a timer switch which comprises a casing; an electric motor mounted on the casing; a cam member of a generally disc-shaped having a cam surface at its periphery, the cam surface being stepped to provide a depressed portion and a shoulder portion adjacent thereto, the cam surface having a notch formed in the shoulder portion, the notch opening to one side of the cam member; and the cam member being operatively connected to the motor for rotation at a constant speed; a shaft mounted on the casing for rotation about and displacement along its axis, the cam member being fixedly mounted on the shaft for rotation therewith, the shaft extending exteriorly of said casing; and an electrical switching means including a pair of first and second contact plates of resilient material fixedly mounted on the casing at their one ends in juxtaposed relation; the second contact plate being biased normally into engagement with the first contact plate for energizing the motor through an associated circuit having a power source, the first contact plate being biased into sliding engagement with the cam surface, whereby upon depression of the first contact plate into the depressed portion, the first contact plate is disengaged from the second contact plate to de-energize the motor while the second contact plate is biased into sliding engagement with the shoulder portion, and upon axial displacement of the shaft in a direction opposite to the one side of the cam member, the second contact plate is moved into the depressed portion through the notch so that the second contact plate is again biased into engagement with the first contact plate to reset the timer switch.

Other advantages, features and additional objects of the present invention will become manifest to those versed in the art upon making reference to the detailed description and the accompanying sheets of drawings in which preferred embodiments incorporating the principles of the present invention are shown by way of illustrative examples.

DESCRIPTION OF THE PREFERRED EMBODIMENTS

A timer switch 10 according to the invention is used, for example, for activating a lamp after a predetermined length of time for indicating that air filters used in an air-conditioner, a clothes dryer or a dehumidifier should be cleaned or replaced, or for indicating that oil should be changed in machine tools.

Figure 3:
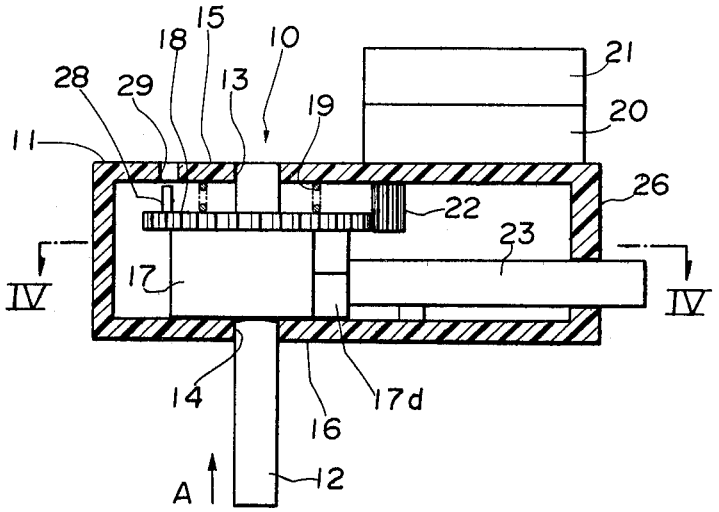
FIG. 3 is a cross-sectional view through a timer switch provided in accordance with the present invention.
Figure 4:
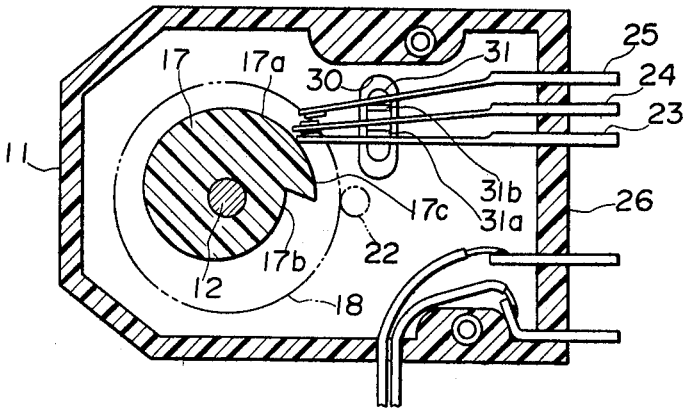
FIG. 4 is a cross-sectional view of the timer switch taken along line IV—IV of FIG. 3.

The timer switch 10 shown in FIGS. 3 and 4 comprises a casing 11 in the form of a box of a rectangular cross-section. A shaft 12 is journalled in a pair of aligned apertures 13, 14 formed through a pair of opposed walls 15, 16 of the casing 11, respectively, so that the shaft 12 is rotatable about and displaceable along the axis thereof. The shaft 12 extends outwardly of the casing wall 16. The shaft is disposed perpendicular to the walls 15, 16. A cam member 17 of a generally disc shaped is fixedly mounted on the shaft 12 for rotation therewith, the cam member 17 being arranged within the casing 11 and disposed perpendicular to the shaft 12. A gear wheel 18 is mated with and secured to one side of the cam member 17, and the shaft 12 extends through the gear wheel 18 at the center thereof. A coil compression spring 19 is arranged around the shaft 12 and acts between the casing wall 15 and the gear wheel 18 so that the other side of the cam member 17 is normally urged into frictional engagement with the inner surface of the casing wall 16. A speed reducer 20 is mounted on the casing wall 15, and an electric motor 21 is mounted on the speed reducer 20. The motor 21 has a rotatable drive shaft (not shown) which is operatively connected to the speed reducer 20. The speed reducer 20 has an output means which is coupled in driving relation to a pinion 22 rotatably supported by the casing wall 15. The pinion 22 is disposed within the casing 11 and meshingly engages the gear wheel 18.

Figure 5A:
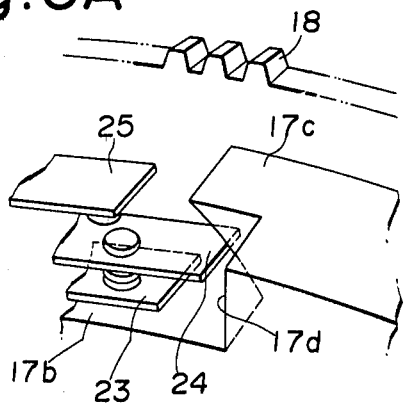
FIGS. 5A to 5C are fragmentary perspective views of the present timer switch, showing the sequence of operation thereof.
Figure 5B:
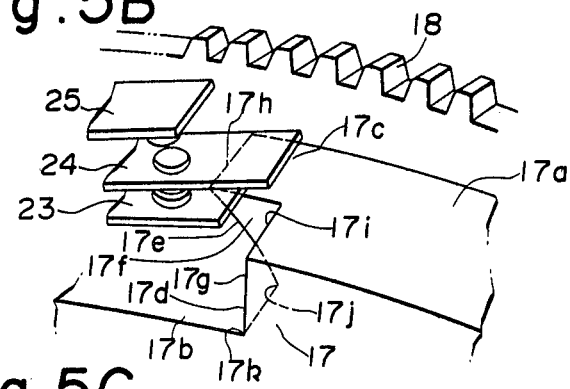
Figure 5C:
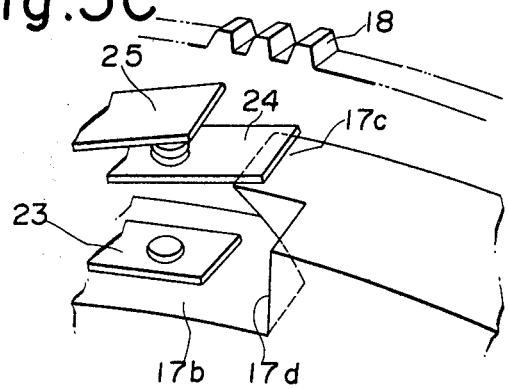

There is provided an electrical switching means which comprises three contact plates 23, 24, 25 made of a resilient material. These contact plates are arranged within the casing 11 in juxtaposed relation, and extend through a wall 26 of the casing 11 at their one ends and are fixed relative thereto. The contact plates 23, 24, 25 are disposed in parallel closely spaced relation to the casing wall 16. The second contact plate 24 extends slightly beyond the free ends of the first and third contact plates 23, 25, as best shown in FIGS. 5A to 5C. The first contact plate 23 is biased into sliding engagement with the cam surface 17*a* at its free end, and the second contact plate 24 is biased normally into engagement with the first contact plate 23 as shown in FIG. 5A. The third contact plate 25 is normally held out of engagement with the second contact plate 24.

The cam member 17 has the cam surface 17*a* at its periphery, the cam surface 17*a* being stepped to provide a depressed portion 17*b* and a shoulder portion 17*c* adjacent thereto. As best shown in FIGS. 5A to 5C, a notch or cutaway recess 17*d* is formed in the shoulder portion 17*c*, the notch 17*d* extending radially to the depressed portion 17*b* and opening to one side of the cam member 17 facing away from the gear wheel 18. The end face 17*e* of the shoulder portion 17*c* is inclined in the direction of the circumference of the cam member 17 and in a direction away from the depressed portion 17*b* so that the shoulder portion 17*c* has a wedge-shaped when viewed in a direction perpendicular to the cam member 17. The adjacent faces 17*f*, 17*g* defining the notch 17*d* are disposed substantially perpendicularly. The edge 17*h* of the shoulder portion 17*c* and the edge 17*i* of the notch 17*d* are disposed substantially in parallel to each other and extend radially of the disc-shaped cam member 17. The inner edge 17*j* of the end face 17*e* of the shoulder portion 17*c* and the inner edge 17*k* of the face 17*g* of the notch 17*d* are disposed in a common line disposed radially of the disc-shaped cam member 17.

A registration pin 28 is fixedly secured to one side of the gear wheel 18 facing away from the cam member 17, the pin 28 being disposed at the marginal portion of the gear wheel 18 and extending in parallel relation to the axis of the shaft 12. The free end of the pin 28 is closely spaced from the casing wall 15. Formed through the casing wall 15 is an aperture 29 into which the registration pin 28 is adapted to be inserted as will hereinafter more fully be described.

Figure 1A:
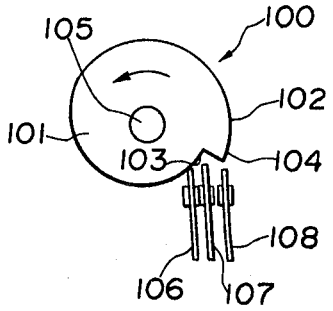
Fig. 1A (PRIOR ART)
FIGS. 1A to 1C are elevational views of a portion of the prior art timer switch, showing the sequence of operation thereof.
Figure 2:
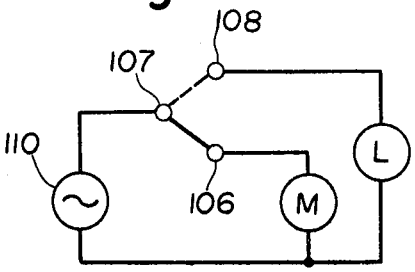
Fig. 2 (PRIOR ART)
FIG. 2 is a circuit diagram of the prior art timer switch of FIGS. 1A to 1C.
Figure 1B:
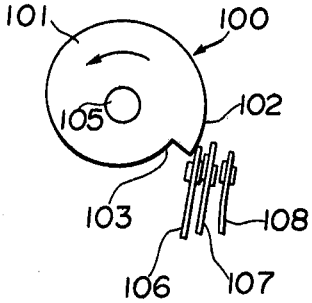
Figure 1C:
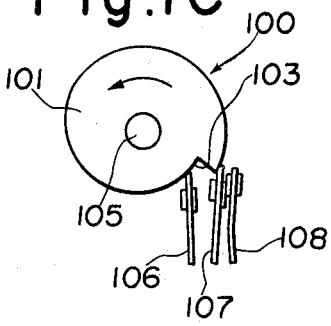

The motor 21 and the three contact plates 23, 24, 25 are electrically connected as described above for the circuit in FIG. 2.

Formed in the casing wall 16 is an elongated slot 30 in which a slider member 31 of a generally oval shape is received for sliding movement therealong. The slider member 31 has a pair of parallel spaced projections 31*a*, 31*b*. The projection 31*a* is normally engaged with the first contact plate 23 intermediate its opposite ends whereas the projection 31*b* is engaged with the third contact plate 25 intermediate its opposite ends. With this arrangement, before the first contact plate 23 moves from the shoulder portion 17*c* into the depressed portion 17*b*, and third contact plate 25 is held out of engagement with the second contact plte 24, as will hereinafter more fully described.

The mode of operation of the timer switch 10 will now be described.

The circuit is energized by an associated supply switch (not shown) so that the motor 21 is powered to rotate the cam member 17 at a constant speed in a counterclockwise direction (FIG. 4) through the speed reducer 20, the pinion 22 and the gear wheel 18 since the second contact plate 24 is biased into engagement with the first contact plate 23 (FIG. 5A). In this condition, the first contact plate 23 is urged into sliding engagement at its free end with the cam surface 17*a*, and the third contact plate 25 is held out of engagement with the second contact plate 24. The cam member 17 is continued to rotate so that the first contact plate 23 slides over the shoulder portion 17*c* (FIG. 5B) into the depressed portion 17*b* under the bias thereof to de-energize the motor 21 whereupon the second contact plate 24 is in turn biased into engagement at its free end with the shoulder portion 17*c* (FIG. 5C). The curvature of the shoulder portion 17*c* is such that upon engagement of the second contact plate 24 with the shoulder portion 17*c*, the third contact plate 25 is brought into engagement with the second contact plate 24 to supply electrical current to the load. Thus, upon introduction of the first contact plate 23 into the depressed portion 17*b*, the rotation of the cam member 17 is stopped since the first contact plate 23 is brought out of engagement with the second contact plate 24 to de-energize the motor 21.

When the cam member 17 is rotated to the position shown in FIG. 5C, the registration pin 28 is disposed in registry with the aperture 29. For resetting the timer switch 10, the shaft 12 is axially displaced against the bias of the coil compression spring 19 as indicated by an arrow A to insert the pin 28 into the aperture 29 so that the shoulder portion 17*c* of the cam member 17 slides across the end of the second contact plate 24 to allow the same to move into the depressed portion 17*b* through the notch 17*d*. Upon introduction of the second contact plate 24 into the depressed portion 17*b*, it becomes disengaged from the third contact plate 25 and is brought into engagement with the first contact plate 23. Upon release of the shaft 12, the cam member 17 is returned to its initial position (FIG. 5A) under the action of the coil compression spring 19 to effect the resetting of the timer switch 10. The provision of the registration pin 28 ensures that the axial displacement of the shaft 12 is effected only when the cam member 17 is rotated to the position shown in FIG. 5C. The shaft 12 is connected to a knob (not shown) whereby the shaft 12 is manually operated. However, the shaft 12 may be operated through a suitable mechanical means.

With this construction, the timer switch 10 can be reset in a quite easy and quick manner.

Figure 6A:
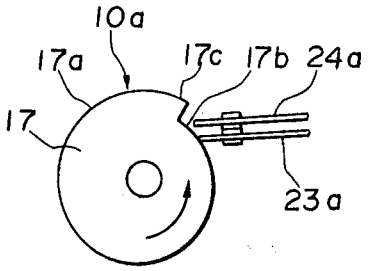
FIGS. 6A to 6C are elevational views of a portion of a modified timer switch.
Figure 6B:
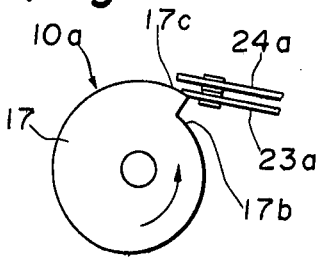
Figure 6C:
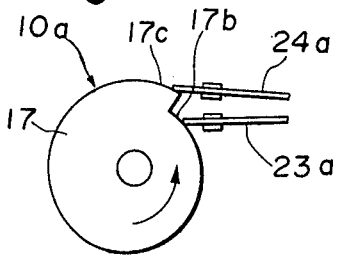
Figure 7:
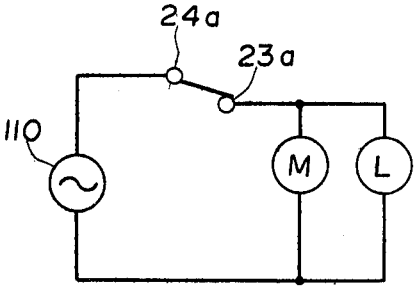
FIG. 7 is a circuit diagram of the modified timer switch.

According to a modified form of the invention shown in FIGS. 6A to 6C, the electrical switching means comprises a pair of first and second contact plates 23*a*, 24*a*. The first contact plate 23*a* is biased into sliding contact with the cam surfaces 17*a*, and the second contact plate 24*a* is biased normally into engagement with the first contact plate 23*a*, as described above for the first embodiment shown in FIGS. 3, 4 and 5A to 5C. An A.C. power source 110, the first and second contact plates 23*a*, 24*a*, a motor M and a load L are electrically connected to provide a circuit as shown in FIG. 7. The circuit is closed while the first and second contact plates 23*a*, 24*a* are engaged with each other. In this condition, the motor M is energized to rotate the cam member 17, and electrical current is delivered to the load L. Upon disengagement of the second contact plate 24*a* from the first contact plate 23*a*, the circuit is opened.

In operation, the timer switch 10*a* is in a preset position in which the second contact plate 24*a* is engaged with the first contact plate 23*a* as shown in FIG. 6A. The circuit is energized to rotate the cam member 17 at a constant speed in a counterclockwise direction. The cam member 17 is continued to rotate so that the first contact plate 23*a* slides over the shoulder portion 17*c* (FIG. 6B) into the depressed portion 17*b* under the bias thereof (FIG. 6C) whereupon the second contact plate 24*a* is in turn biased into engagement with the shoulder portion 17*c*. At this time, the motor M is de-energized to stop the rotation of the cam member 17, and the supply of electrical current to the load L is stopped. To reset the timer switch 10*a*, the shaft 12 is axially displaced, as described above for the first embodiment, so that the shoulder portion 17*c* slides across the end of the second contact plate to allow the same to move into the depressed portion 17*b* through the notch 17*d*. Upon release of the shaft 12, the cam member 17 is returned to its initial position (FIG. 6A) under the action of the coil compression spring 19 to effect the resetting of the timer switch 10*a*. In this embodiment, the slider member 31 is not used.

While the timer switches according to the invention have been specifically shown and described herein, the invention itself is not to be restricted by the exact showing of the drawings or the description thereof. For example, the second contact plate 24 may have at its free end a cut-away portion which opens in a direction toward the gear wheel 18. Such a cut-away portion is cooperative with the notch 17*d* in the shoulder portion 17*c* so that the axial movement of the shaft 12 is reduced by a distance corresponding to the width of the cut-away portion when resetting the timer switch in the manner described above.

What is claimed is:

1. A timer switch which comprises:

(a) a casing;

(b) an electric motor mounted on said casing;

(c) a cam member of a generally disc-shape having a cam surface at its periphery, said cam surface being stepped to provide a depressed portion and a shoulder portion adjacent thereto, said cam member being operatively connected to said motor for rotation at a constant speed;

(d) a shaft mounted on said casing for rotation about its axis, said cam member being fixedly mounted on said shaft for rotation therewith, said shaft extending exteriorly of said casing; and (e) an electrical switching means including a pair of first and second contact plates of resilient material fixedly mounted on said casing at their one ends in juxtaposed relation;

said second contact plate being biased normally into engagement with said first contact plate for energizing said motor through an associated circuit having a power source, said first contact plate being biased into sliding engagement with said cam surface, whereby upon depression of said first contact plate into said depressed portion, said first contact plate is disengaged from said second contact plate to de-energize said motor while said second contact plate is biased into sliding engagement with said shoulder portion, the improvement wherein said cam surface has a notch formed in said shoulder, said notch opening to one side of the cam member; said shaft being operable to be displaced together with said cam member along an axis thereof relative to said casing, whereby upon axial displacement of said shaft in a direction opposite to the one side of said cam member when said second contact plate is in engagement with said shoulder portion, said second contact plate is moved into said depressed portion through said notch so that said second contact plate is again biased into engagement with said first contact plate to reset and timer switch.

2. A timer switch according to claim 1, in which said electrical switching means further includes a third contact plate of resilient material fixedly mounted at its one end on said casing, said first, second and third contact plates being disposed in juxtaposed relation, upon disengagement of said first contact plate from said second contact plate, said third contact plate being brought into engagement with said second contact plate, and upon axial displacement of said shaft in a direction opposite to the one side of said cam member, said second and third contact plates being moved into said depressed portion through said notch so that said second contact plate is disengaged from said third contact plate and again biased into engagement with said first contact plate to reset said timer switch.

3. A timer switch according to claim 1 or claim 2, further including an urging means urging said cam member in a direction opposite to the other side of said cam member.

4. A timer switch according to claim 1 or claim 2, in which said first contact plate engages said cam surface at its free end, and said second contact plate being engageable with said cam surface at its free end.

5. A timer switch according to claim 4, in which said second contact plate extends beyond the free ends of said first and third contact plates.

6. A timer switch according to claim 1 or claim 2, in which the end face of said shoulder portion is inclined in a direction of the circumference of said cam member and in a direction away from said depressed portion.

7. A timer switch according to claim 1 or claim 2, in which said casing has a wall disposed parallel to the other side of said cam member, said cam member having a registration pin fixedly secured to the other side thereof and spaced closely from said wall, and said wall having an aperture with which said registration pin is brought into registry when said cam member is rotated to the position where said second contact plate is biased into engagement with said cam surface, whereby upon axial displacement of said shaft, said registration pin is inserted into said aperture.

8. A timer switch according to claim 2, further including a slider member slidably member on said casing, said slider member having a pair of spaced first and second projections, said first projection being normally engaged with said first contact plate whereas said second projection is engaged with said third contact plate whereby before said first contact plate moves from said shoulder portion into said depressed portion, said third contact plate is held out of engagement with said second contact plate.

* * * * *